US006861938B2

(12) United States Patent
Yamada et al.

(10) Patent No.: US 6,861,938 B2
(45) Date of Patent: Mar. 1, 2005

(54) HIGH-FREQUENCY POWER INDUCTANCE ELEMENT

(75) Inventors: Katsuo Yamada, Shizuoka (JP); Fumiaki Nakao, Shizuoka (JP); Tomoyuki Akaya, Shizuoka (JP); Satoshi Ota, Shizuoka (JP)

(73) Assignee: FDK Corporation, Tokyo (JP)

( * ) Notice: Subject to any disclaimer, the term of this patent is extended or adjusted under 35 U.S.C. 154(b) by 0 days.

(21) Appl. No.: 10/669,123

(22) Filed: Sep. 23, 2003

(65) Prior Publication Data

US 2004/0125628 A1 Jul. 1, 2004

Related U.S. Application Data

(63) Continuation of application No. PCT/JP02/02610, filed on Mar. 19, 2002.

(51) Int. Cl.[7] ..... H01F 27/24
(52) U.S. Cl. ..... 336/212; 336/200; 336/83
(58) Field of Search ..... 336/212, 213, 336/83, 200, 223, 232, 209

(56) References Cited

U.S. PATENT DOCUMENTS 4,507,640 A * 3/1985 Rich et al. ..... 336/223
4,562,382 A * 12/1985 Elliott ..... 315/219
2002/0079775 A1 * 6/2002 Janssen et al. ..... 310/208

FOREIGN PATENT DOCUMENTS

| | | | |
|---|---|---|---|
| JP | 4-338616 | A | 11/1992 |
| JP | 6-96971 | A | 4/1994 |
| JP | 6-196341 | A | 7/1994 |
| JP | 7-7111 | | 1/1995 |
| JP | 2000-133532 | A | 5/2000 |
| JP | 2000-261135 | A | 9/2000 |
| JP | 2002-33226 | A | 1/2002 |

OTHER PUBLICATIONS

International Search Report for PCT/JP02/02610 mailed Apr. 30, 2002; ISA/JPO.

* cited by examiner

*Primary Examiner*—Anh Mai
(74) *Attorney, Agent, or Firm*—Harness, Dickey & Pierce, P.L.C.

(57) ABSTRACT

A high frequency power inductance element capable of remarkably reducing a leakage by remarkably reducing an interwinding capacity, remarkably increasing heat radiation from coils, and remarkably improving productivity and a cost, comprising coils formed of a band-shaped conductor spirally wound in a cylindrical shape so that the wider surfaces thereof come flush with each other, an electrically insulated bobbin for installing the coils thereon, and cores inserted into the bobbin to form a closed magnetic circuit.

2 Claims, 4 Drawing Sheets

HIGH-FREQUENCY POWER INDUCTANCE ELEMENT

CROSS-REFERENCE TO RELATED APPLICATIONS

This application is a continuation of the International Application No. PCT/JP02/02610 filed on Mar. 19, 2002 which was published in Japanese language on Oct. 3, 2002.

TECHNICAL FIELD

The present invention relates to a high-frequency power inductance element, in particular relates to such which is effective by being adapted to a high-frequency power transformer or a choke coil to be mounted on a board.

BACKGROUND ART

A high-frequency power inductance element such as a high-frequency power transformer and a choke coil is often used in, for example, an inverter-type power supply device which processes electric source by temporary conversion of the source to high frequency. This type of inductance element is required to have smaller interwinding capacity and satisfactory radiative heat dissipation for processing high power or large current with high frequency. Further, in order to assemble a compact and low cost power supply device and the like using an inductance element, there is preferred a configuration where the inductance element is capable of being mounted directly on a printed circuit board, particularly a configuration adapted for surface mounting.

As a conventional type of inductance element, as described in Japanese Patent Application Laid-open Publication No. 2000-223320 for example, there have been those having a structure where oblate-sheet shaped one-turn coils are formed from a copper sheet stamped out as substantially a U-shape (or a C-shape), and are laminated with insulating sheets, and where a pair of E-shaped cores (magnetic cores) are fit by insertion into the laminated one. Both end portions of the respective one-turn coils are integrally formed with terminal portions, and a coil with a predetermined number of turns (or a predetermined inductance value) is capable of being formed by appropriately connecting the terminal portions.

Further, an edgewise coil has also been used as the above coil. The edgewise coil is formed of a rectangular copper strip spirally wound a predetermined number of times, the wider surfaces of which are overlapped with a predetermined interwinding space. The entire winding of the edgewise coil is integrated continually, so that electrical resistance of the coil is capable of being made smaller than that of a coil formed of one-turn coils laminated and connected.

However, for a conventional high-frequency power inductance element in which a coil thereof is formed of oblate-sheet shaped one-turn coils laminated, there has been required a step of laminating a plurality of the one-turn coils with insulating sheets while positioning the one-turn coils mutually, and there has further been required a step of connecting the one-turn coils. Therefore, in the conventional high-frequency power inductance element, there has been a problem that assembling is troublesome and productivity is low. Further, since the insulating sheets laminated with the one-turn coils prevents radiative heat dissipation from the one-turn coils, there has also been a problem that radiative heat dissipation is low.

Further, for a conventional high-frequency power inductance element in which an edgewise coil is used, since a step of winding the coil while overlapping the wider surfaces of a rectangular copper strip of the coil is difficult, there has been a problem of low productivity of the coil. Further, in order to stably retain interwinding space of the edgewise coil, it is necessary to intervene sheet insulator between the strips. However, the intervention of the insulator causes a problem of obstructing radiative heat dissipation from the coil, which is similar to the problem in the above-described laminated type.

In both the above-described two types of inductance elements, since the interwinding space of the coil windings has a structure in which the wider surfaces of the rectangular copper strip face each other, there has been a problem that interwinding capacity of the inductance elements is large, and that as a consequence, leakage of electromagnetic noise of the inductance elements used as a high-frequency power transformer or a choke coil is large due to such interwinding capacity.

SUMMARY OF THE INVENTION

The present invention is made in view of the above problems, and one object is to provide a high-frequency power inductance element that is easy to process and assemble, outstanding in productivity and cost excellence, satisfactory for radiative heat dissipation, and that the interwinding capacity thereof is capable of being decreased.

In order to achieve the above described object and other objects, the present invention provides a high-frequency power inductance element which is characterized by comprising: a coil formed of a band-shaped conductor spirally wound in a cylindrical shape so that the wider surfaces thereof come flush with each other; an electrically insulated bobbin for mounting said coil thereon; and a core inserted into said bobbin to form a closed magnetic circuit.

DETAILED DESCRIPTION OF THE INVENTION

According to a high-frequency power inductance element according to an embodiment of the present invention, the coil may be formed by using a band-shaped conductor which is formed into rectangular staggered patterns extending in the same direction as a whole while bending in an L-shape to the left and right, and by folding the conductor in the vertical and horizontal direction alternately relative to the pattern plane so as to be wound spirally in a cylindrical shape. A rectangular copper strip may be used as the band-shaped conductor.

According to another embodiment of this invention, the coil may be mounted so that the wider surfaces of the band-shaped conductor contact a mounting surface. Further, end portions of the band-shaped conductor forming the coil may be used as coil terminals. Further, the middle portion of the band-shaped conductor may be used as a middle tap-out terminal of the coil.

According to still another embodiment of this invention, two bobbin portions which are integrally formed may be used as the bobbin. In this case, the coils are mounted on the outer surfaces of the two bobbin portions respectively, and both leg portions of the core in a U-shape are inserted into both the bobbin portions, and each top end surface of the leg portions is magnetically bridged by the core in an I-shape, thereby an annular closed magnetic circuit which magnetically couples together each of the coils, is formed. The bobbin may be integrally formed with a tray portion which positions and fixes the core, and which electrically insulates the core from a mounting surface. Further, the bobbin may be formed with a fixing tab used for mounting on a printed circuit board.

According to further embodiments of this invention, by providing a plurality of the coils to form a primary coil and a secondary coil, a high-frequency power transformer may be formed. Further, a choke coil may also be formed of the coil. In this case, the choke coil may be formed by providing a plurality of the coils, and by connecting a plurality of the coils in series or in parallel.

Hereinbelow, with reference to the attached drawings, a preferred embodiment of this invention is described.

Figure 1:
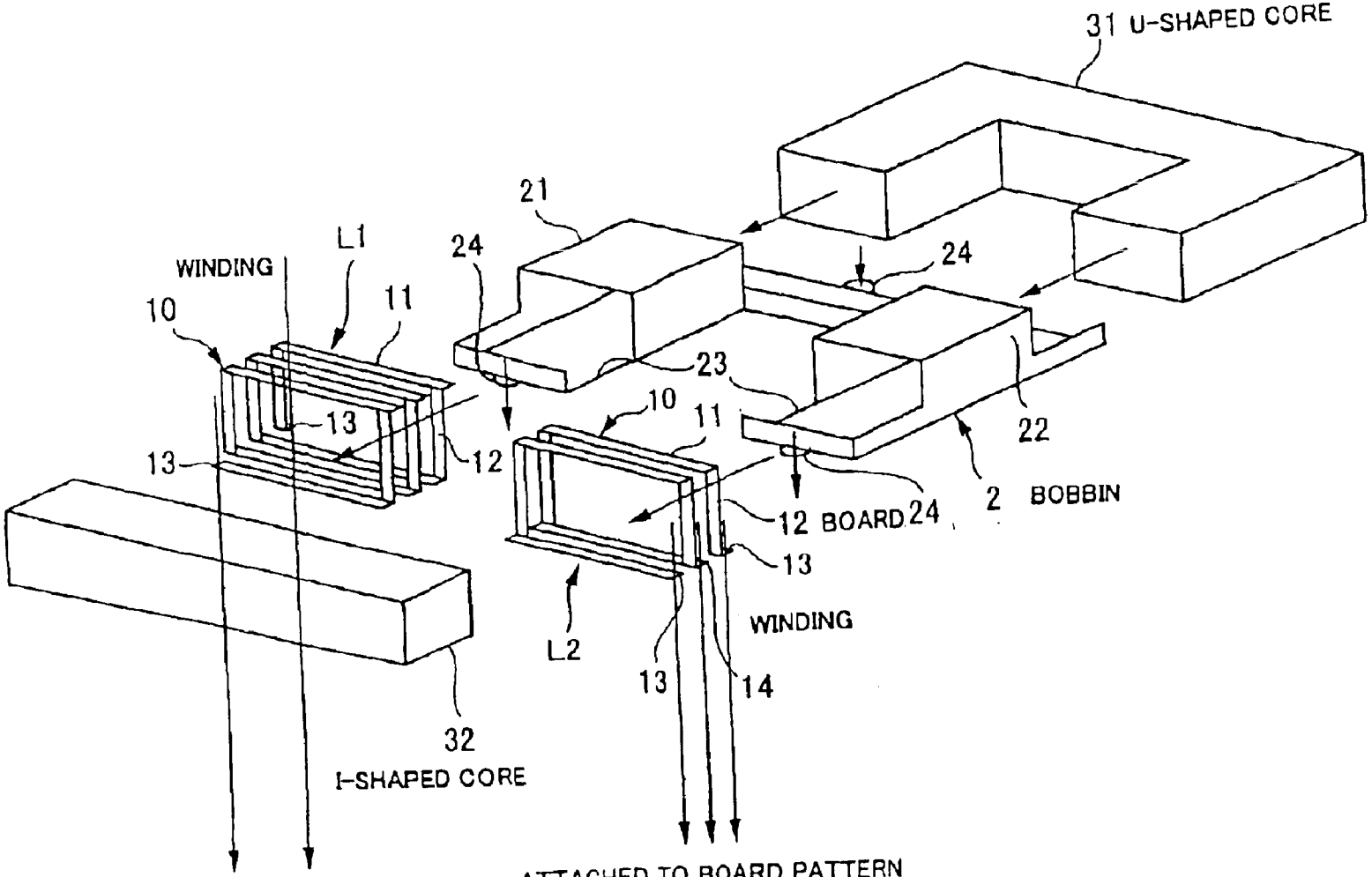
FIG. 1 is an exploded perspective view showing an embodiment of a high-frequency power inductance element according to the present invention.

FIG. 1 is an exploded perspective view showing an embodiment of a high-frequency power inductance element according to this invention.

The inductance element shown in the same figure is formed as a high-frequency power transformer, and is structured by a primary coil L1 and a secondary coil L2, each of which is wound a predetermined number of times in a rectangular spiral shape, a coil bobbin 2 which retains in shape and holds the primary coil L1 and the secondary coil L2 respectively from the inside, and cores (magnetic cores) 31, 32 which are fit by insertion into the coil bobbins 2 to form a closed magnetic circuit which pass through the above primary coil L1 and the secondary coil L2.

Here, the primary coil L1 and the secondary coil L2 are respectively formed by spiral winding, in a rectangular cylindrical shape, a thin band-shaped copper sheet, namely a rectangular copper strip 10, in a state that its wider surfaces come flush with each other, that is, in a state that both width ends (edges) of the rectangular copper strip 10 are overlapped in the same direction with a predetermined interwinding space. The rectangular copper strip 10 is formed by stamping out a copper sheet to a flat pattern shape shown in FIG. 2.

The coil bobbin 2 is formed from a material of electrical insulation such as resin, and the two bobbin portions 21, 22 are formed integrally with a tray portion 23. The two bobbin portions 21, 22 are respectively formed as a rectangular cylindrical shape with open ends, and the primary coil L1 is mounted on the outer surface of the bobbin portion 21, and the secondary coil L2 is mounted on the outer surface of the other bobbin portion 22. Further, both leg portions of the U-shaped core (magnetic core) 31 are fit by insertion into the inside of the two bobbin portions 21, 22. By magnetic bridging of each top end surface of both the leg portions fit by insertion into the bobbin portions 21, 22 of the U-shaped core 31 to the I-shaped core 32, the U-shaped core 31 forms a rectangular closed magnetic circuit. Note that both cores 31, 32 are formed from ferrite.

The tray portions 23 position and fix the U-shaped core 31 and the I-shaped core 32 so that they form a closed magnetic circuit, and insulate both the cores 31, 32 from a mounting surface (printed circuit board). The tray portions 23 are integrally formed with fixing tabs 24 used for mounting on the printed circuit board. The fixing tab 24 is formed with an engagement claw for catching in a hole on the printed circuit board, or is formed with a threaded hole for screwing on the printed circuit board.

As described above, the coil bobbin 2 in the embodiment is capable of holding and retaining in shape the coils L1 and L2, positioning and fixing the cores 31, 32 and insulating the cores 31, 32 from the mounting surface, and mounting and fixing the entire transformer on the printed circuit board, as a single component.

Figure 2:
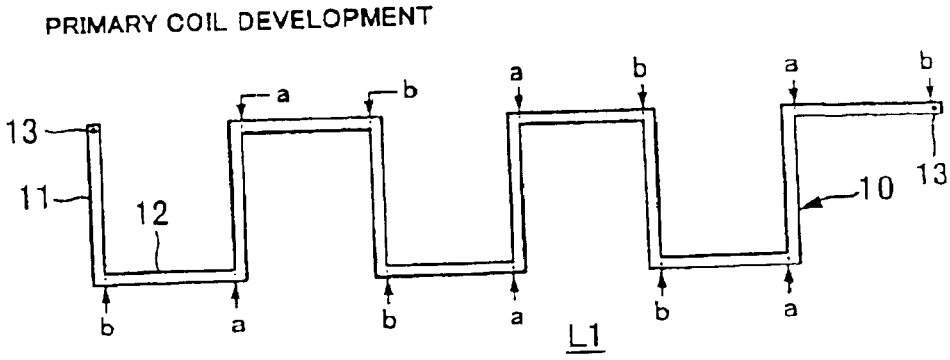
FIG. 2 is a developed view of a primary coil and a secondary coil.
Figure 2:
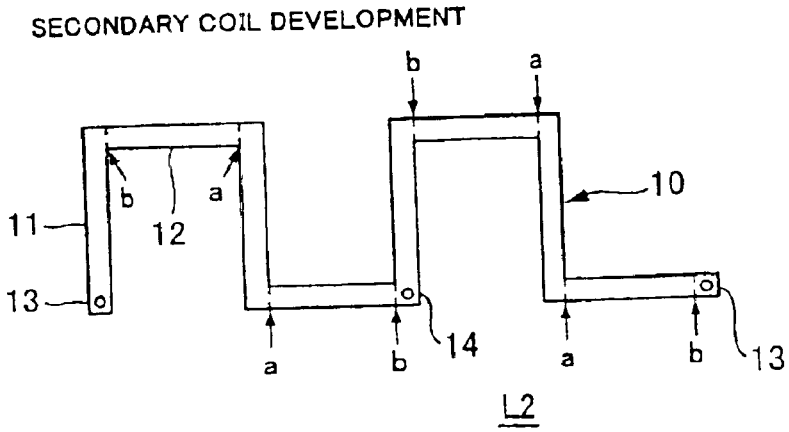

FIG. 2 shows a developed view of the primary coil L1 and the secondary coil L2.

Figure 3:
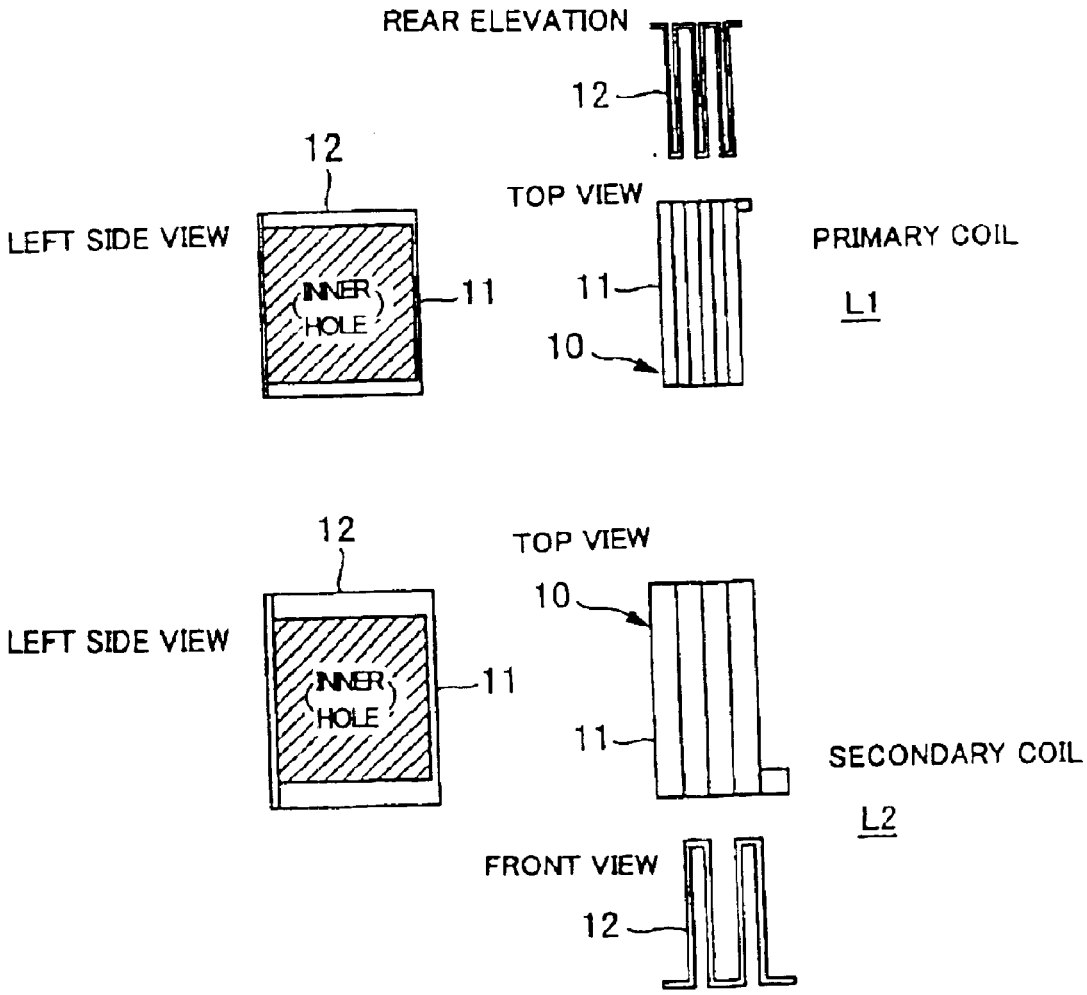
FIG. 3 shows three plan views showing external appearances of the primary coil and the secondary coil.

FIG. 3 shows three plan views of external appearances of the primary coil L1 and the secondary coil L2.

In FIG. 2, "a" shows a mountain fold (valley fold) part, and "b" shows a valley fold (mountain fold) part, respectively. The rectangular copper strip 10 is cut out as a rectangular staggered pattern which extends in the same direction as a whole while bending in an L-shape to the left and right. That is, a linear portion (orthogonal portion) 11 which is orthogonal to the extending direction and a linear portion (parallel portion) 12 which is parallel to the extending direction are alternately connected to form a flat pattern shape. By folding the portions along both edges of the orthogonal portion 11 (dotted line portion) alternately in the vertical direction and the horizontal direction relative to the pattern plane at the corner portions where the orthogonal portion 11 and the parallel portion 12 are connected, the coils L1, L2 are capable of being formed of the rectangular copper strip 10 spirally wound in a rectangular cylindrical shape, both ends of the wider surfaces of which are overlapped in the same direction with a predetermined interwinding space (pitch space) in a simple and accurate way.

Further, as shown in FIG. 3, both end portions of the rectangular copper strip 10 forming the coils L1, L2, are capable of being used as terminals 13 of the coil, without modifying its shape or by providing a threaded hole or the like. Further, if necessary, the middle portion of the rectangular copper strip 10, especially the end portion of the orthogonal portion, is capable of being used as a pull terminal 14 of a middle tap. In this way, various winding structures (specification) is capable of being selected, after winding and mounting the coils L1, L2.

Figure 4:
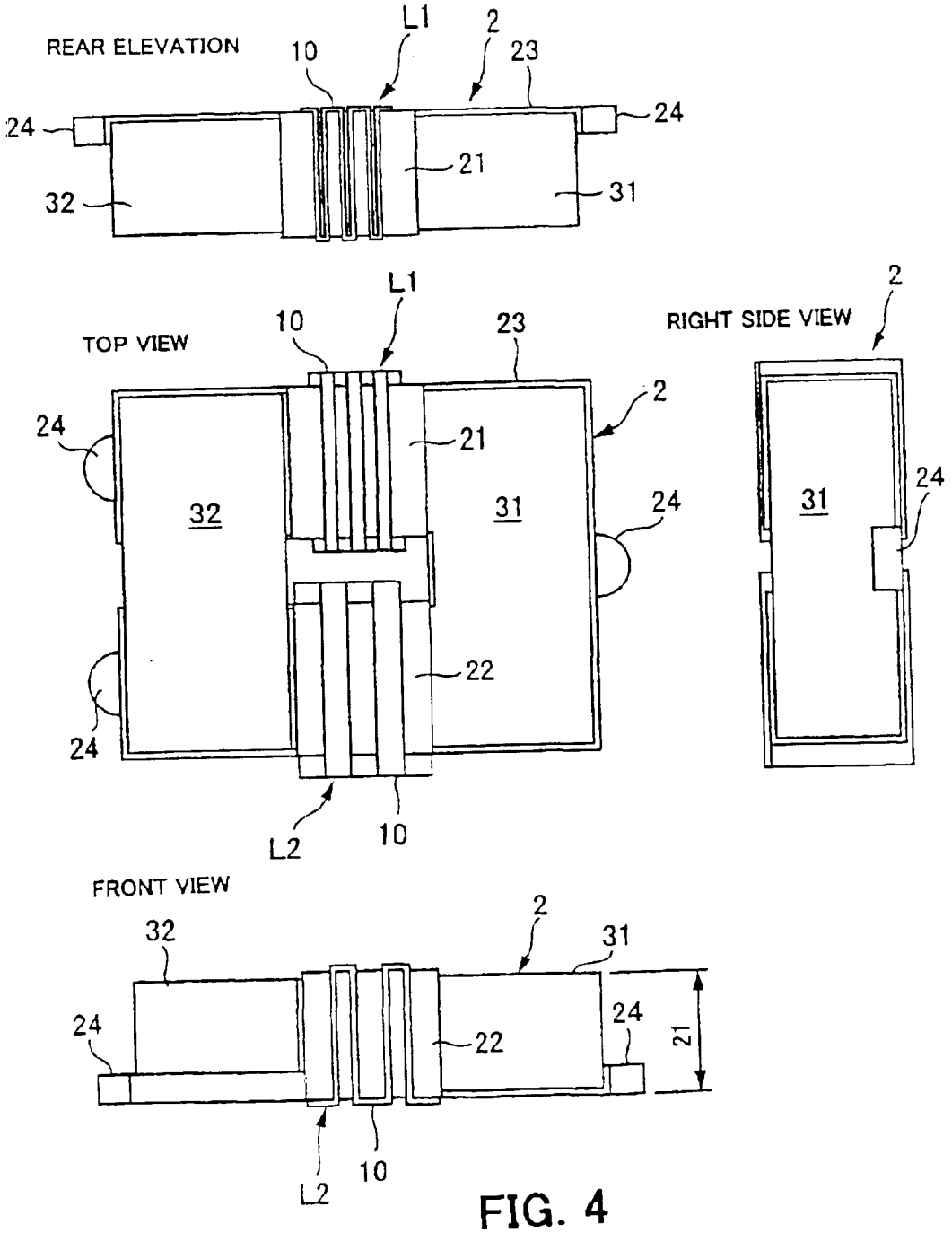
FIG. 4 shows four plan views showing assembled final drawing of a high-frequency power transformer.

FIG. 4 shows four plan views of a finally assembled one of the above-described high-frequency power transformer.

As shown in the same figure, with respect to the above-described high-frequency power transformer, the wider surfaces of the rectangular copper strip 10 forming the coils L1, L2 are made to contact the printed circuit board. In this way, the coils L1, L2 are capable of being connected directly to a conductive land of the printed circuit board by a solder, conductive paste, or screws made from an electrically conductive material, and the like, and by selecting the position and pattern shape of the conductive land, the middle tap-out terminals of the coils L1, L2 are capable of being directly taken out of the coils. That is, with respect to the above-described high-frequency power transformer, the rectangular copper strip 10 forming the coils L1, L2 of the transformer functions as a terminal for being connected to the printed circuit board and the like, without modification.

As described above, with respect to the high-frequency power transformer in the embodiment, first, since the coils L1, L2 of the transformer are spirally wound in a rectangular cylindrical shape in a state that edges of the rectangular copper strip 10 are overlapped in the same direction with a predetermined interwinding space, interwinding capacity is capable of being significantly decreased from that of a conventional coil wound in a state that the wider surfaces are overlapped to each other. In this way, it is possible to significantly decrease high-frequency leakage due to the interwinding capacity. Further, since the wider surfaces of the rectangular copper strip 10 forming the coils L1, L2 face the inner surface and the outer surface of the coils, radiative heat dissipation is capable of being significantly increased from that of the conventional coil, the wider surfaces of which are hidden between the conductors. Since the winding process of the coils L1, L2 is capable of being performed by folding in a simple and accurate way, and further since the terminals 13, 14 are capable of being taken directly out of the coils, productivity and cost efficiency is also significantly improved than before.

As described above, the present invention is described based on one embodiment, but various embodiments of the present invention other than the above may be implemented. For example, the rectangular copper strip 10 forming coils L1, L2 may be band-shaped conductors for which electrically conductive materials other than copper are used. Further, when forming a coil by spirally winding the band-shaped conductor, there may be used, for example, a strip cut out as a trapezoid turnover pattern shape, other than that cut out as a rectangular staggered pattern shape described above. Further, by curving either one or both of the orthogonal portion 11 and the parallel portion 12 of the above rectangular staggered pattern, in an arc shape, it is possible to form a spiral coil having a shape close to that of a cylinder.

In regards to an application of the present invention, the above-described embodiment is a high-frequency power transformer, but the present invention may be applied as it is to a high-frequency power inductance element other than a transformer, for example, to a high-frequency power choke coil. The high-frequency power transformer of the above-described embodiment, by connecting its primary coil L1 and secondary coil L2 in series or in parallel, may be used as a choke coil with an enhanced inductance value or a choke coil with an enhanced permissible current value. That is, by providing a plurality of coils and appropriately connecting the coils, an inductance element with various specifications may be obtained with the same or with a few types of products.

The high-frequency power inductance element according to the present invention, has a coil formed of a band-shaped conductor spirally wound in a cylindrical shape so that the wider surfaces thereof come flush with each other, an electrically insulated bobbin for mounting the coil thereon, a core which is inserted into the bobbin to form a closed magnetic circuit, so that interwinding capacity is capable of being greatly decreased, which leads to a significant decrease of leakage, and radiative heat dissipation from the coil is also capable of being greatly increased, and productivity and cost efficiency is also capable of being significantly improved than before.

Further, by using a band-shaped conductor which is formed into staggered patterns extending in the same direction as a whole while bending in an L-shape to the left and right, and by folding the conductor in the vertical and horizontal direction alternately relative to the pattern plane so as to be spirally wound in a cylindrical shape, a coil having smaller interwinding capacity and outstanding radiative heat dissipation is capable of being formed in a simple and accurate way.

What is claimed is:

1. A high-frequency power inductance element comprising:

a coil formed of a band-shaped conductor spirally wound in a cylindrical shape so that the wider surfaces thereof come flush with each other;

an electrically insulated bobbin for mounting said coil thereon; and a core inserted into said bobbin to form a closed magnetic circuit;

wherein the middle portion of the band-shaped conductor forming said coil is formed as a middle tap-out terminal of said coil.

2. A high-frequency power inductance element according to claim 1, wherein said coil is formed of the band-shaped conductor wound spirally in a cylindrical shape such that said band-shaped conductor being formed into rectangular staggered patterns which extend in the same direction as a whole while bending in an L-shape to the left and right, is folded in the vertical and horizontal direction alternately relative to the pattern plane.

* * * * *